United States Patent [19]

Thompson, III

[11] Patent Number: 4,597,674

[45] Date of Patent: Jul. 1, 1986

[54] MULTIPLEX DIGITAL CLOCK

[76] Inventor: William H. Thompson, III, 143 N. 58th St., Philadelphia, Pa. 19139

[21] Appl. No.: 595,561

[22] Filed: Mar. 30, 1984

[51] Int. Cl.[4] ..... G04C 19/00

[52] U.S. Cl. ..... 368/83; 368/241

[58] Field of Search ..... 368/83, 241, 240

[56] References Cited

U.S. PATENT DOCUMENTS

| | | | |
|---|---|---|---|
| 3,922,847 | 12/1975 | Culley et al. | 368/241 |
| 3,955,354 | 5/1976 | Kilby et al. | 368/240 |
| 4,074,515 | 2/1978 | Asano | 368/83 |

*Primary Examiner*—Bernard Roskoski

*Attorney, Agent, or Firm*—Thomas M. Ferrill, Jr.; John W. Logan, Jr.; David J. Johns

[57] ABSTRACT

Different from a standard digital display utilizing separate digits for seconds, minutes and hours, an electronic timepiece which uses tow digits composed of triads of red, green and yellow L.E.D.s. Each L.E.D. color is synchronically sequenced and each period of display is for one-third of a second. Each color L.E.D. is dedicated to a particular element of time, i.e., red represents second, yellow represents minutes and green represents hours.

5 Claims, 5 Drawing Figures

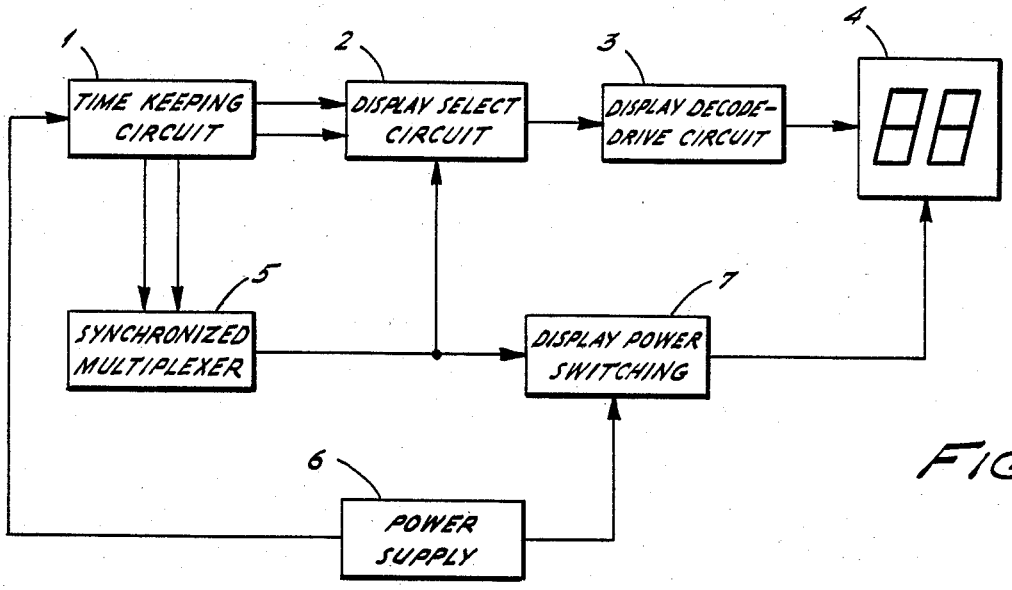
FIG. 1.
FIG. 3.
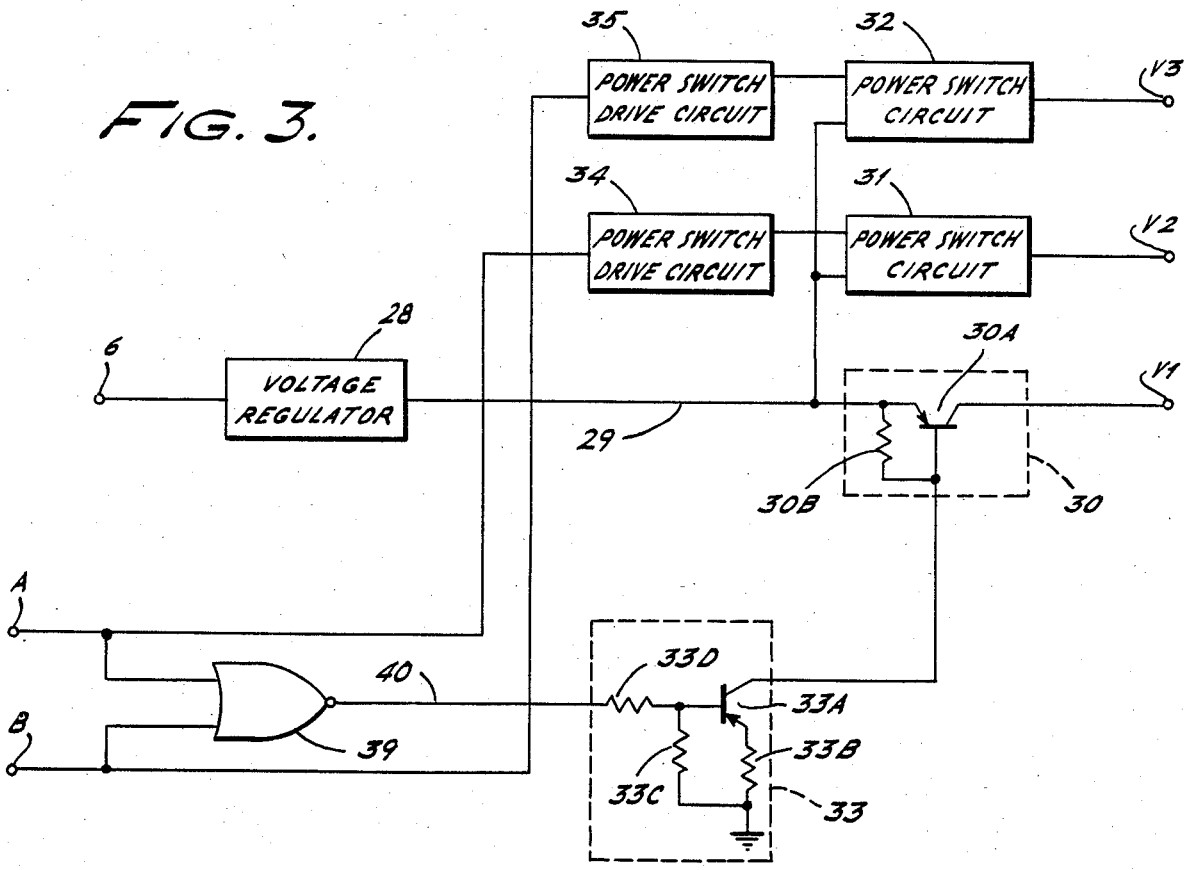

MULTIPLEX DIGITAL CLOCK

FIELD OF INVENTION

This invention relates to electronic digital timepieces and in particular to a digital display multiplexing seconds, minutes and hours on a display panel of moderately large size.

BACKGROUND OF INVENTION

The basic purpose of any timepiece is to provide the observer with information indicating the time of day. Formats available range from the sundial to talking clocks. It should be apparent that some display methods are more legible and/or attractive than others. Conventional digital time-pieces require two digits for the display of each time element, i.e., hours, minutes and seconds. Although easily legible, extended viewing of a virtually static display becomes monotonous.

SUMMARY OF INVENTION

It is an object of the present invention to provide a moderately large electronic timepiece utilizing two digits to display three time units each; synchronized to real time and displayed for one-third second. It is a further object to provide distinction between time units by displaying each in a dedicated color.

The invention makes it possible to provide a wall-mounted electronic timepiece using two digits multiplexed to display color-coded hour, minute and second information in a quick-paced, but easily readable format.

DESCRIPTION OF THE DRAWINGS

The form, purpose and advantages will be more fully understood from the following description of a preferred embodiment shown by way of example in the attendant drawings.

FIG. 1 is a block diagram showing the circuitry and display system of an electronic timepiece in accordance with present invention.

FIG. 3 is a diagram of the display power switching circuit of FIG. 1.

DESCRIPTION OF PREFERRED EMBODIMENT

FIG. 1 shows a block diagram of circuitry and digital L.E.D. display device of an electronic timepiece in accordance with the invention.

The circuit contains a timekeeping circuit 1 which derives its reference from the 60 hz power line, a dividing circuit to provide 30 hz and 1 hz standard signals. Timekeeping circuitry 1 also provides binary coded decimal outputs representing hour, minute and second data. Operating power is provided by a power supply of standard configuration.

Figure 5:
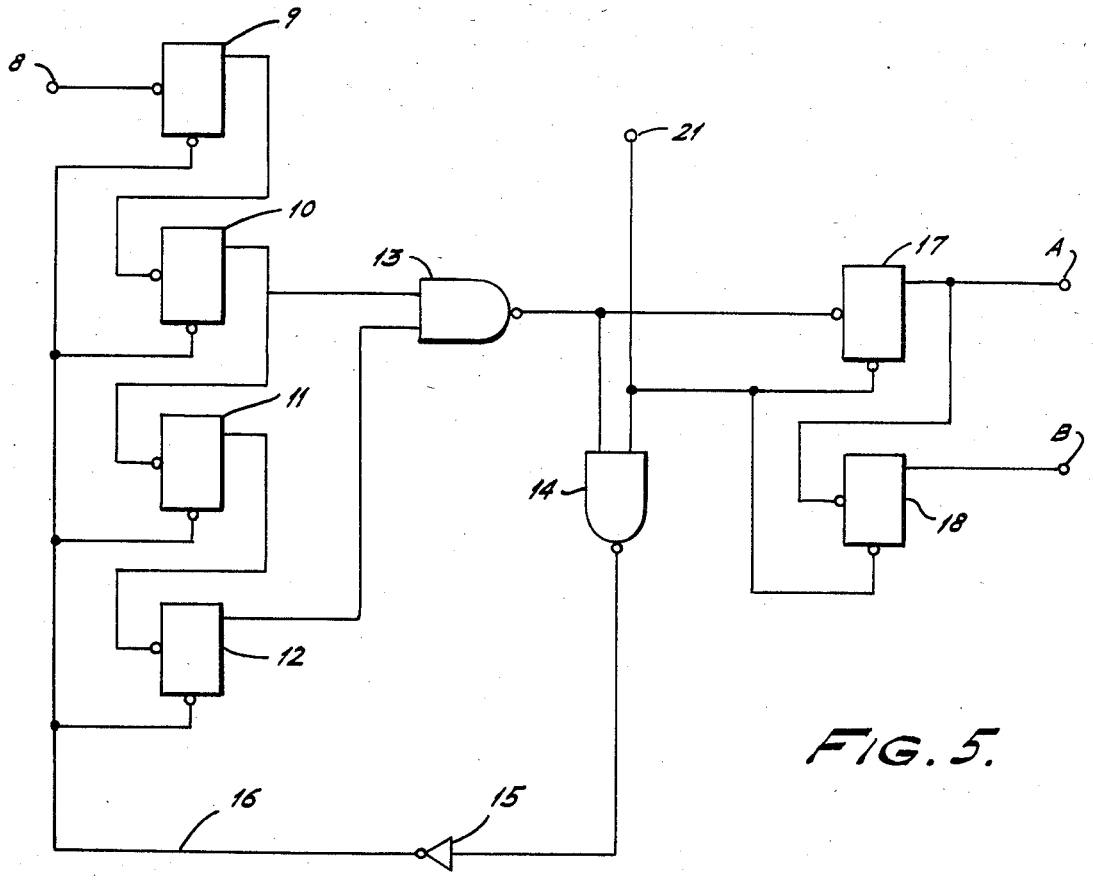
FIG. 5 is a diagram of the synchronized multiplexer circuit of FIG. 1.

With reference to FIG. 1, 30 hz and 1 hz pulse signals are applied from the timekeeping circuit 1 to a synchronized multiplexer 5 one embodiment of which is shown in FIG. 5. As shown in this embodiment, a 30 hz sq. wave 8 is applied to the input terminal of a four-bit B.C.D. counter comprised of FIG. 5 counters 9 through 12. The output of counters 10 and 12 is applied to the inputs of NAND gate 13. Thus, at the start of the eleventh period there will be a low output from NAND gate 13. Connected to the output of gate 13 is one input of NAND gate 14. The output of gate 14 is applied to an inverter 15. Terminal 16 which is the output of inverter 15 is applied to the reset inputs of BCD counters 9 through 12. Therefore, when either input of gate 14 is at a low level there will be a high level at the input of inverter 15 and following inversion there will be at terminal 16 a reset pulse at counters 9 through 12. Therefore, the 30 hz sq. wave from time keeping circuit 1 will be divided by a factor of ten due to the described connection and functions of counters 9 through 15.

Timekeeping circuit 1 has an output pulsed low at a 1 hz rate signal 21. This pulse is the real time synchronizer used to synchronize the state of the divider circuit embodied in counters 9 through 12 and multiplexer embodied by counters 17 and 18 with the timekeeping circuit 1. Synchronization of divider counters 9 through 12 is as follows: Signal 21 is applied to one input of gate 14, thus when signal 21 pulses low the output of gate 14 goes to a high level which is applied to the input of inverter 15 where it appears as output 16 which at this time is now low, thus counters 9 through 12 are reset to zero.

Reference FIG. 5 with a 30 hz sq. wave 8 applied to BCD counter 9, function of the circuit comprised of BCD counters 9 through 12, NAND gates 13 and 14 and inverter 15 will produce a low pulse at a rate of one every one-third second at the output of inverter 15.

This output is connected to the clock input of negative edge triggering counter 17 which will subsequently clock counter 18. The code controlling the time element displayed and corresponding display color is produced by the outputs of counter 17 and 18. The code is as follows: signal A and signal B, low, hours displayed; A high and B low, minutes displayed and A low and B high, seconds displayed. 1 hz signal 21 connected to the reset terminals of BCD counters 17 and 18 assures synchronization of said counters with timekeeping circuit 1.

Figure 2:
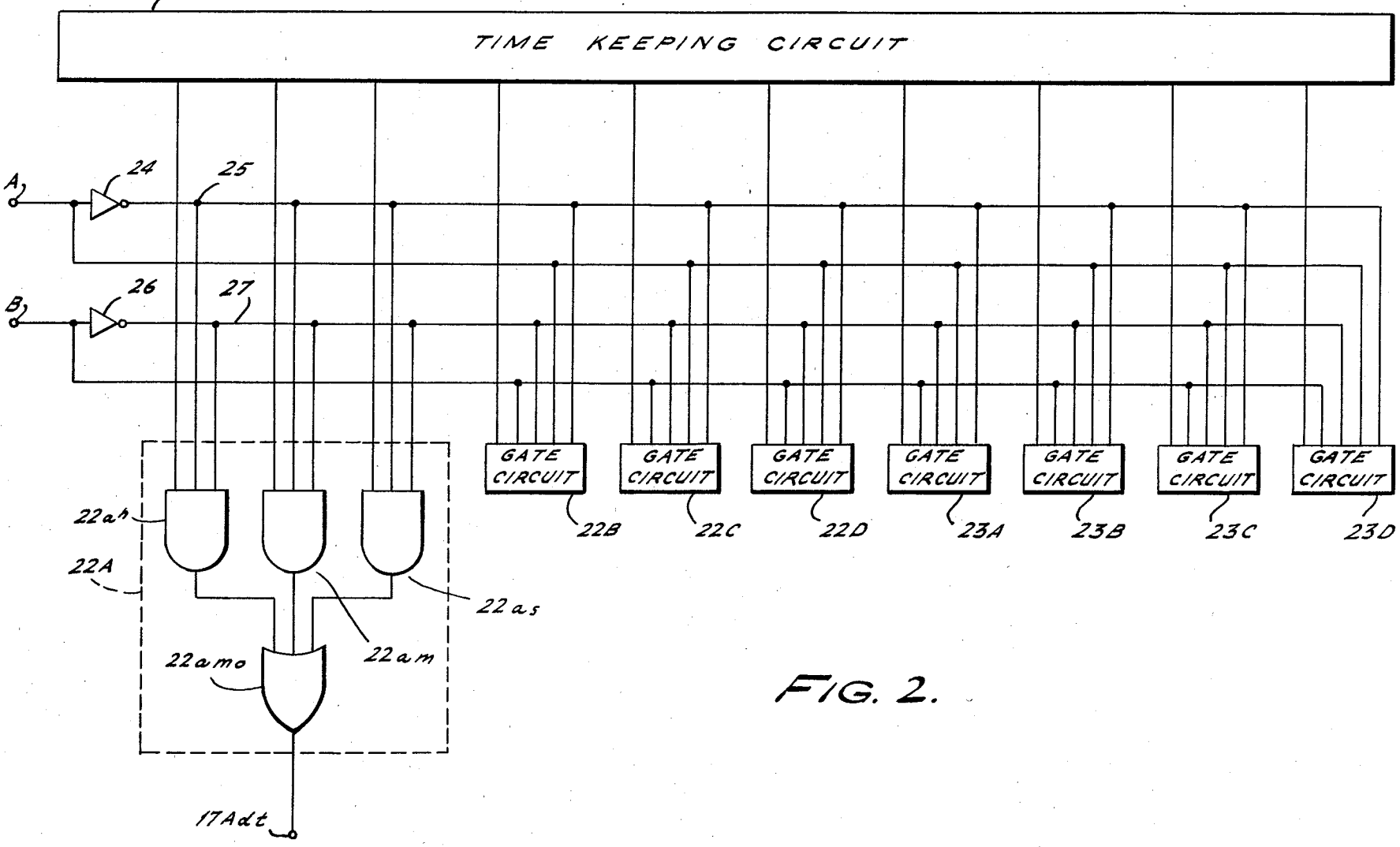
FIG. 2 is a circuit diagram of display select 2 of FIG. 1.

A detailed analysis of the display select circuit 2, FIG. 1 is shown by way of example in FIG. 2 as being composed of eight gate circuits 22A through 22D and 23A through 23D of identical structure. Each comprises three AND gates, each with three inputs. The outputs of said AND gates are connected to a three-input OR gate 37A through 37D and 38A through 38D the output of which constitutes the product of the subject display select circuit.

Reference timekeeping circuit 1, hour, minute and second data is each arranged in a four-bit BCD format, A B C D. Each bit of data for each unit of time for each digit is inputted to a dedicated, previously described AND gate. One bit of data, bit A, relevant to the tens position will be exemplified as the other bits B through D are of similar structure. When hours are displayed, signal A and B is low, the output of inverter 24 is high and is connected by line 25 to AND gate **22*ah*. B-Inverter output 26 will also be high and is connected to gate 22*ah* by connection to line 27. Thus, AND gate 22*ah*** is enabled to pass hours data through OR gate amo.

When minutes are to be displayed, signal A will be high and signal B low. Signal A is connected to gate **22*am* and therefore maintains an input high. Signal B following inversion by inverter 26 appears at another input of gates 22***am* through 27. With two inputs high gate 22*am* is enabled to pass minutes data through gate 22*amo*.

The display of seconds involves the following: Signal A will be low and signal B high. Signal A is inverted by inverter 24 and is connected to gate 22*as* by line 25. Signal B is connected to another input of AND gate 22*as*, thus enabling said gate to pass seconds data through to OR gate 22*amo*.

Display decode drive circuit 3, multiplexed hour, minute and second data ATDO—AODO—DODO is applied to B C D to seven segment decoder the outputs of which each drives a power transistor which sinks current from that particular display segment.

Referring to FIG. 3 shows by way of example one embodiment of a display power switching circuit 7. The circuit is composed of the following elements: An adjustable voltage regulator 28, power switches 30, 31, 32 and power switch drivers 34, 35. There is also a means to detect signals A and B low and to then produce a high level suitable to drive display 4.

When signals A and B are low, NOR gate 39 output will be high. One end of resistor 33D is tied to the output of gate 39. Resistors 33D and 33C form a voltage divider with the base of transistor 33A at their junction. Transistor 33A will therefore conduct to a degree determined by the value of transistors 33D, 33C and emitter resistance 33B. The collector current of transistor 33A will be a constant level, regardless of changes in its source of voltage line 29. The conduction of transistor 33A sinks transistor 30A base current; therefore, causing transistor 30A to conduct. Output transistor 30A has its emitter connected to line 29. Resistor 30B serves to stabilize transistor 30A. The collector of transistor 30A is tied to and is the source of display voltage V1. PSD 2-3 and PS 2-3 are of similar structure and function.

Figure 4:
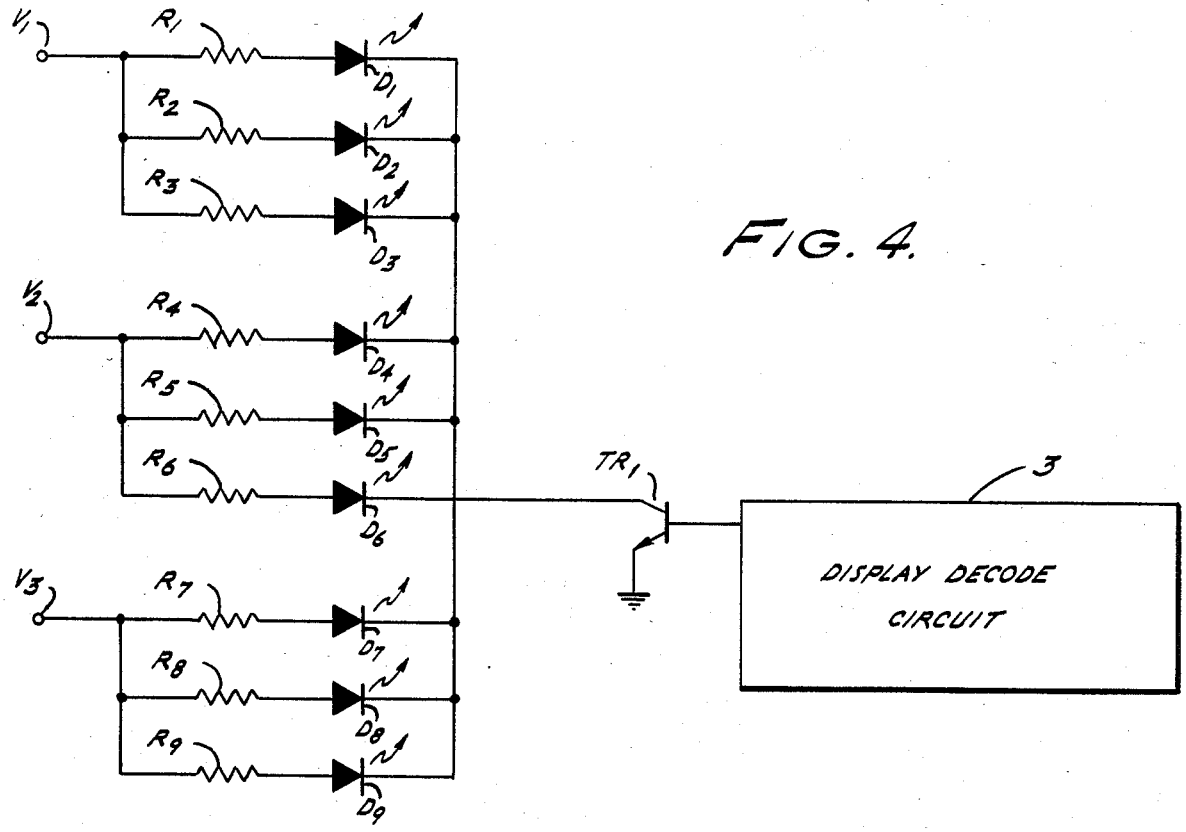
FIG. 4 is a plan of the display, Item 4 circuit of FIG. 1.

Referring to FIG. 4 shows by example a preferred embodiment of the display panel shown in FIG. 1. Tens segment 'A' will be explained, only, as segments b-g are of similar construction. The cathodes of green L.E.D.s D1 through D3 are tied together and then connected to the cathodes of yellow L.E.D.s D4 through D6 and to the red L.E.D.s D7 through D9 to form a common terminal that is driven by transistor TR1. The output of the seven segment tens decoder 3 drives TR1. The anodes of L.E.D.'s D1 through D9 are singularly tied to one end of resistors R1–R9. The other end of R1-9 is terminated as follows:

R1-3 connects to hour drive source V1
R4-6 connects to minute drive source V2
R7-9 connects to second drive source V3

Thus the energizing and color of any segment requires the conduction of its cathode sink transistor and V 1, 2 or 3 present.

The L.E.D.s are arranged in triads composed of red, green and yellow lamps. The triads are then grouped in close proximity to form the impression of a continuous display segment.

In the present embodiment, the time units of hours, minutes and seconds are synchronized with real time so that for the first one-third second hours are displayed, during the second one-third minutes are displayed and the final one-third displays seconds. The invention is in no way limited to the embodiment shown in the drawing and herein particularly described. The spirit of the invention exceeds the descriptions and claims herein. As an example, a single L.E.D. with TRI-color capability could be substituted for the L.E.D. TRIAD method used in this embodiment.

What I claim is:

1. An electronic timepiece apparatus for sequentially displaying seconds, minutes and hours, each in a different color code, on single display, comprising:

a two-digit, numeric L.E.D. display, the elements of said display each being composed of a triad of three L.E.D.'s, of which each L.E.D. is of one of three colors, said L.E.D. display thereby being capable of displaying two digit numbers in one of three colors;

a power supply;

a display driver circuit connected to said L.E.D. display to selectively power L.E.D. elements of said first color, said second color and said third color, said driver circuit also being connected to said power supply;

a time keeping circuit connected to said power supply for simultaneously supplying a train of first, faster clock pulses and a train of second, slower clock pulses;

a multiplexer circuit connected to said time keeping circuit to receive both said first clock pulses and said second clock pulses, said multiplexer circuit providing output signals to said display driver circuit;

a display select circuit connected to receive said multiplexer circuit output signals and connected to receive said first clock pulses and said second clock pulses from said time keeping circuit; and a display decode-drive circuit connected to said display select circuit output, said display decode-drive circuit having its output connected to said L.E.D. display.

2. The apparatus of claim 1 wherein said first clock pulses occur at a frequency of 30 per second (30 Hz) and said second clock pulses occur at a frequency of 1 per second (1 Hz).

3. The apparatus of claim 1 wherein said multiplexer circuit includes:

a four-bit BCD counter connected to receive said first clock pulses from said time keeping circuit;

a first NAND gate having its inputs connected to the output from the second and fourth bits of said BCD counter;

a second NAND gate having one input connected to receive said second clock pulses from said time keeping circuit and from said first NAND gate, said second NAND gate output being connected to reset said four-bit BCD counter; and a two-bit counter connected to provide a first signal A (least significant bit) and said two-bit counter being incremented by a connection to the output of said first NAND gate and being reset/clocked by a connection to said second clock pulses.

4. The apparatus of claim 3 wherein said display select circuit includes a plurality of individual gate circuits, each said gate circuit being connected to said display decode drive circuit, each said gate circuit including three three-input AND gates connected in parallel to feed an OR gate, said OR gate output being the output of said gate circuit; a first inverter having a by-pass line to provide said first signal A and its complement; and a second inverter having a by-pass line to provide said second signal B and its complement; the first of said three input AND gates being connected on its input to receive said second clock pulses, said first inverter output and said second inverter output; the second of said three input AND gates being connected to receive said second clock pulses, said first inverter by-pass and said second inverter output; and the third of said three input AND gates being connected to receive said second clock pulses, said first inverter output and said second inverter by-pass.

5. The apparatus of claim 4 wherein said display driver circuit includes:

a voltage regulator connected to said power supply;

a first power transistor connected with its emitter terminal tied to said voltage regulator output and its collector terminal providing an output signal to said L.E.D. display first color diodes, said power transistor having a resistor connected between its emitter and base terminals;

a grounding transistor connected to said first power transistor base terminal for providing selectively a path to ground;

a NOR gate connected to receive said first signal A and said second signal B, from said multiplexer circuit two-bit counters, on its inputs, said NOR gate output being connected to enable said grounding transistor to conduction;

a first power switch drive circuit connected to receive said first signal A;

a second power switch circuit implemented by a second power transistor having a structure like said first power transistor, said second power transistor switch circuit being connected to said first power switch drive circuit output;

a second power switch drive circuit connected to receive said second signal B; and a third power switch circuit implemented by a third power transistor having a structure like said first power transistor, said third power transistor switch circuit being connected to said second power switch drive circuit output;

wherein said second power transistor output is connected to drive a second said L.E.D. display color and said third power power transistor output is connected to drive a third said L.E.D. display color.

* * * * *